United States Patent [19]

Hiraga et al.

[11] Patent Number: 4,705,383

[45] Date of Patent: Nov. 10, 1987

[54] DEVELOPING APPARATUS

[75] Inventors: Yuji Hiraga, Nara; Tatsuya Ito, Yamatokoriyama, both of Japan

[73] Assignee: Sharp Kabushiki Kaisha, Osaka, Japan

[21] Appl. No.: 807,459

[22] Filed: Dec. 10, 1985

[30] Foreign Application Priority Data

Dec. 10, 1984 [JP] Japan ..... 59-188347[U]
Dec. 10, 1984 [JP] Japan ..... 59-188349[U]

[51] Int. Cl.[4] ..... G03G 15/08
[52] U.S. Cl. ..... 355/3 DD; 355/14 D
[58] Field of Search ..... 355/3 DD, 14 D, 15

[56] References Cited

U.S. PATENT DOCUMENTS 4,391,512 7/1983 Nakamura et al. ..... 355/3 DD
4,422,749 12/1983 Hoshino et al. ..... 355/3 DD
4,563,978 1/1986 Nakamura et al. ..... 355/3 DD X
4,592,653 6/1986 Ikeda et al. ..... 355/3 DD

*Primary Examiner*—A. C. Prescott
*Attorney, Agent, or Firm*—Birch, Stewart, Kolasch & Birch

[57] ABSTRACT

A developing apparatus for use in an electrophotographic copying machine or the like, which includes a magnet roller having in it, a main pole magnet, with one of its poles directed outwardly and interpole magnets, with their poles opposite in polarity to the one of the poles of the main pole magnet being directed outwardly so as to attract a developing material composed of toner and carrier onto the surface of the magnet roller through magnetic induction of the main pole magnet and interpole magnets, and a doctor blade for restricting the amount of attraction of the developing material onto the surface of the magnet roller. The doctor blade has a magnet member provided in it, with its pole having the same polarity as that of the outer side pole of the main pole magnet being adapted to confront the magnet roller.

5 Claims, 4 Drawing Figures

DEVELOPING APPARATUS

BACKGROUND OF THE INVENTION

The present invention generally relates to electrophotography and more particularly, to a developing apparatus for supplying developing material onto the surface of a photoreceptor in a developing process of an electrophotographic copying machine and the like.

For feeding developing material onto the surface Pa of a photoreceptor P in the form, for example, of a drum endless belt or the like, there has conventionally been employed a developing apparatus D as shown in FIG. 1, which includes a developing sleeve or magnet roller Rm rotatably provided in a housing Dh so as to be partially exposed through an opening Da of the housing Dh to confront the photoreceptor P, and a stirring roller Rs also rotatably disposed in the housing Dh in which the developing material m is accommodated. The magnet roller Rm made of a hollow pipe of an electrically insulative material includes therein a main pole magnet M1 having one magnetic pole thereof directed outwardly, and interpole magnets M2 each having its magnetic pole opposite in polarity to that of the above one magnetic pole of the main pole magnet M1, directed outwardly. Upon rotation of the stirring roller Rs, the developing material m is subjected to triboelectric charging so as to be attracted onto the surface of the magnet roller Rm by the magnetic induction of the magnets M1 and M2 disposed therein. For stably supplying the developing material m onto the surface Pa of the photoreceptor P, it is necessary to restrict or limit the amount of the developing material m to be attracted onto the surface of the magnet roller Rm to a predetermined rate, and for this purpose, a doctor blade B is provided adjacent to the lower portion of the magnet roller Rm. Thus, by the attraction of the developing material m onto the surface of the magnet roller Rm (referred to as brush bristle formation hereinafter), the developing material is supplied onto the surface Pa of the photoreceptor P as the magnet roller Rm rotates.

In the conventional developing apparatus as described so far, however, there has been such a disadvantage that, since the magnetic brush bristles of the developing material thus formed are directed upwardly and downwardly with respect to the central position of the main pole magnet M1 of the magnet roller Rm, faulty bristle formation tends to take place in the vicinity of the central portion of the main pole magnet, and it becomes impossible to stably supply a sufficient amount of developing material onto the photoreceptor surface, thus resulting in a deteriorating quality of the copied images. There has also been such an inconvenience that the developing material not attracted onto the photoreceptor surface Pa adheres to the surface of the doctor blade B to give rise to faulty bristle formation, or such developing material falls onto copy paper sheets to obstruct formation of copied images in good quality.

Meanwhile, the developing material as described so far may be broadly divided into a mono-component developing material employing toner of a magnetic material, and a dual-component developing material composed of toner of thermoplastic resin powder and magnetic carrier. In the dual-componoent developing material as referred to above, the toner and carrier having different charging tendencies are stirred by the stirring roller Rs so as to be charged respectively into different polarities by triboelectric charging. Through selection of raw materials for the above toner and carrier by taking into account the frictional order in the charging tendency, the toner is charged in a polarity opposite to that of the charge imparted to the surface Pa of the photoreceptor P, and thus, in the developing process, only the toner is attracted onto the surface Pa of the photoreceptor P. In the conventional developing apparatus, however, since the doctor blade B for restricting the bristle formation by the developing material on the surface of the magnet roller Rm is made of a non-magnetic material, the carrier charged to the same polarity as that on the photoreceptor surface Pa tends to fall of the magnet roller Rm during supply of the toner in the developing process to adhere onto the surface of the doctor blade B, and such carrier adhering onto the doctor blade surface is increased with the increase in the number of copying operations and falls down spontaneously or by the vibration of the copying machine, etc., thereby soiling the interior of the machine or copy paper sheets, or obstructing formation of copied images in good quality.

SUMMARY OF THE INVENTION

Accordingly, an essential object of the present invention is to provide an improved developing apparatus for use in an electrophotographic copying machine and the like, in which bristle formation by the developing material on a magnet roller is stabilized during developing step in the copying process, while adhesion of the developing material onto the surface of a doctor blade, which may result in soiling of the machine interior and copy paper sheets, is prevented.

Another important object of the present invention is to provide a developing apparatus of the above described type which is simple in construction and stable in its functioning, and can be readily incorporated into electrophotographic copying machines and the like at low cost.

In accomplishing these and other objects, according to one preferred embodiment of the present invention, there is provided a developing apparatus which includes a magnet roller having a main pole magnet provided therein, with one of its poles directed outwardly and interpole magnets also provided therein, with poles thereof opposite in polarity to the one of the poles of said main pole magnet being directed outwardly so as to attract a developing material composed of toner and carrier onto the surface of the magnet roller through magnetic induction of the main pole magnet and interpole magnets, and a doctor blade for restricting the amount of attraction of the developing material onto the surface of the magnet roller and is characterized in that the doctor blade is provided therein with a magnet member, with its pole having the same polarity as that of the outer side pole of the main pole magnet being adapted to confront the magnet roller.

By the arrangement according to the present invention as described above, not only is the undesirable adhesion of the developing material onto the surface of the doctor blade prevented, but the developing material may be stably supplied onto the surface of the photoreceptor, since the direction of the bristle formation by the developing material in the vicinity of the doctor blade can be directed towards the main pole magnet, and thus, copied images at high quality are formed at all times.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
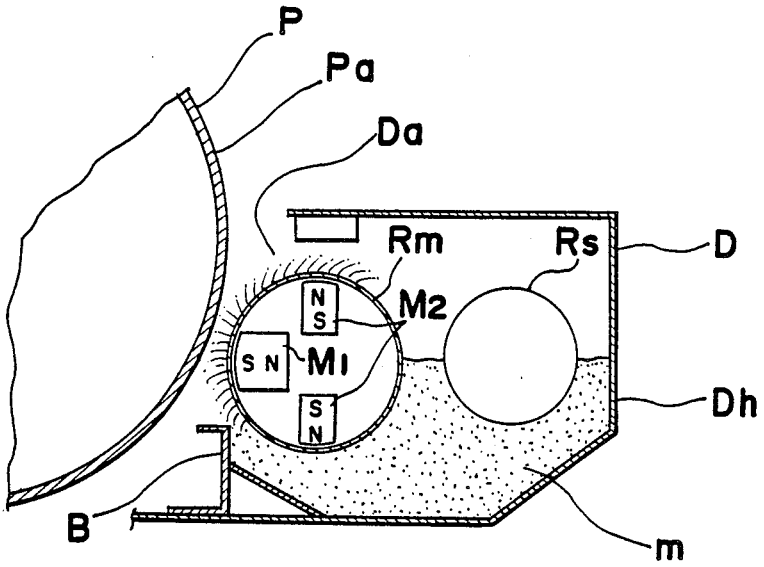
Fig. 1 PRIOR ART
FIG. 1 is a schematic side sectional view showing construction of a conventional developing apparatus (already referred to)

Before the description of the present invention proceeds, it is to be noted that like parts are designated by like reference numerals throughout the accompanying drawings.

Figure 2:
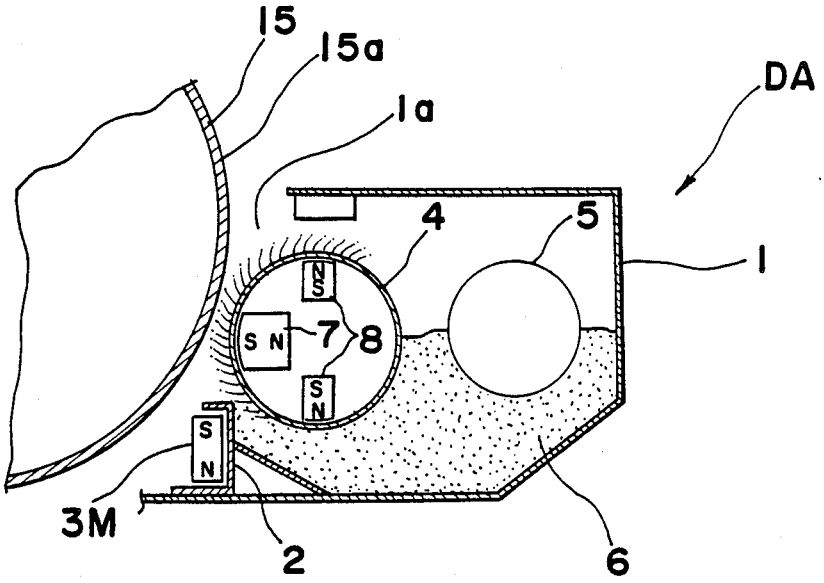
FIG. 2 is a schematic side sectional view showing construction of a developing apparatus according to one preferred embodiment of the present invention.

Referring now to the drawings, there is shown in FIG. 2, an improved developing apparatus DA according to one preferred embodiment of the present invention.

The developiing apparatus DA generally includes a housing 1 having an opening 1*a* confronting the surface 15*a* of a photoreceptor 15 in the form, for example, of a drum and accommodating therein developing material 6, a magnet roller 4 rotatably provided in the housing 1 so as to be partially exposed towards the photoreceptor surface 15*a* through the opening 1*a*, and a stirring roller 5 also rotatably disposed in the housing 1. In the magnet roller 4 made, for example, of an electrically insulative hollow pipe, there are accommodated a main pole magnet 7 having its one magnetic pole e.g. S pole directed outwardly, and interpole magnets 8 each having its magnetic pole e.g. N pole opposite in polarity to the above one magnetic pole S of the magnet 7 directed outwardly as illustrated. A doctor blade 2 is disposed adjacent to the lower portion of the magnet roller 4 for restricting formation of magnetic brush bristles by the developing material 6 on the surface of the magnet roller 4. The construction of the developing apparatus DA described so far is generally the same as that of the conventional developing apparatus explained with reference to FIG. 1. According to the present invention, the developing apparatus DA further includes a magnet member 3M provided within the doctor blade 2, with its magnetic pole e.g. S pole having the same polarity as that of the outer pole S of the main pole magnet 7 being directed to confront the magnet roller 4.

Figure 3:
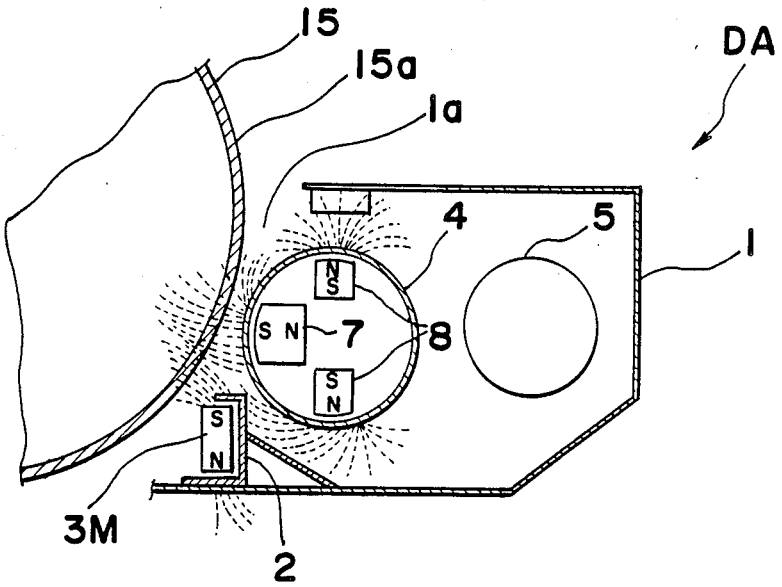
FIG. 3 is a view similar to FIG. 2; which particularly shows distributions of magnetic lines of force therein.

By the above arrangement of the developing apparatus DA according to the present invention, Magnetic lines of force are distributed in the vicinity of the photoreceptor surface 15*a* and the magnet roller 4 as shown in FIG. 3. More specifically, in a position lower than the central portion of the main pole magnet 7 for the magnet roller 4, the magnetic lines of force by the S pole of the main pole magnet 7 are directed horizontally or upwardly by the repelling with respect to the magnetic force of the magnet member 3M disposed within the doctor blade 2. Accordingly, the magnetic lines of force are not separated upwardly and downwardly at the central portion of the main pole magnet 7 as in the conventional arrangement, and the state of bristle formation at the central portion of the main pole magnet 7 which is the supplying position of the developing material 6 onto the photoreceptor surface 15*a* can be improved. Furthermore, since the undesirable adhesion of the developing material onto the surface of the doctor blade 2 may be prevented without distribution of the magnetic lines of force in the direction of the surface of the doctor blade 2 as in the conventional developing apparatus, the restriction of bristle formation by the developing material may be effectively made.

Figure 4:
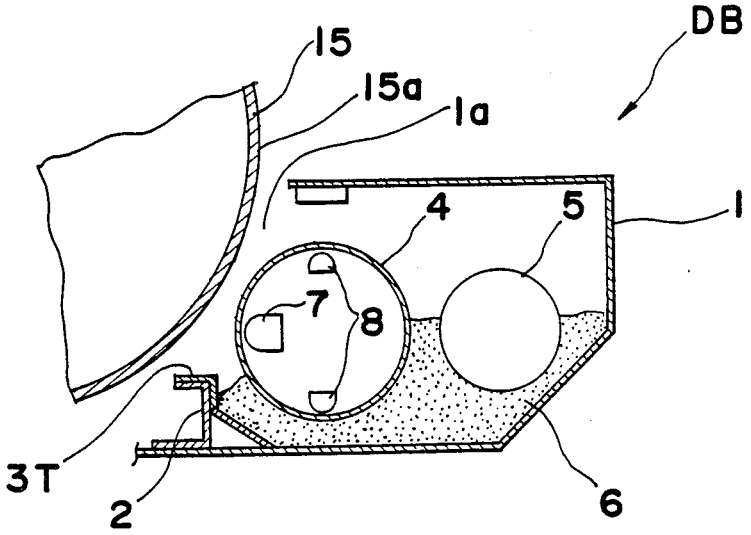
FIG. 4 is a view similar to FIG. 2, which particularly shows a modification thereof.

Referring further to FIG. 4, there is shown a modification of the developing apparatus DA described so far with reference to FIG. 2.

In the modified developing apparatus DB in FIG. 4, the magnet member 3M described as disposed within the doctor blade 2 in the arrangement of FIG. 2 is replaced by a tape 3T of Teflon (name used in trade and manufactured by Du Pont) applied at least onto the surface of the doctor blade 2 confronting the magnet roller 4 as shown. The material for the above Teflon tape 3T is one located at a lower rank in the series of the triboelectric charging coefficients that the carrier constituting the developing material 6, and is chared to a negative polarity by the friction with respect to said carrier.

In the above arrangement, the surface 15*a* of the photoreceptor 15 is preliminarily charged to a negative polarity by a corona charger (not shown) in a known manner. On the other hand, the developing material 6 accommodated in the housing 1 is agitated by the stirring roller 5 so that the toner is charged to a positive polarity, while the carrier is charged to a negative polarity.

Furthermore, the Teflon tape 3T covering the surface of the doctor blade 2 as described earlier is charged to negative polarity through friction with respect to the carrier, and therefore, during supplying of the developing material 6 onto the photoreceptor surface 15*a*, only the toner charged to the positive polarity in the developing material adhering to the surface of the magnet roller 4, is attracted onto the photoreceptor surface 15*a*. The carrier which is the other component constituting the developing material 6 is repelled from the photoreceptor surface 15*a*, since said carrier is charged to the same negative polarity as that of the photoreceptor surface 15*a*, and remains on the surface of the magnet roller 4 or falls onto the doctor blade 2. In this case, since the Teflon tape 3T on the surface of the doctor blade 2 is charged to the same negative polarity as that of the carrier, they repel each other. Accordingly, the carrier does not adhere onto the surface of the doctor blade 2, and thus, never gives rise to malfunctions at the rotating portions by falling into the interior of the machine, nor causes faulty transfer of toner during transfer process by falling onto copy paper sheets in transportation. Therefore, favorable copied images may be provided at all times. Moreover, since the charge imparted to the Teflon tape 3T is sufficiently small as compared with that imparted to the photoreceptor surface 15*a*, there is no possibility that the toner adheres to the Teflon tape.

It should be noted here that the material for covering the surface of the doctor blade is not limited to such a tape of Teflon as described above, but other material may be employed so far as it is electrically insulative and has a lower rank in the series of triboelectrical charging coefficients than the material for the carrier.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing apparatus comprising:

a magnetic roller having a main pole magnet and interpole magnets provided therein, a first pole of said main pole magnet being directed outwardly with the first pole of each of said interpole magnets being opposite in polarity to the first pole of said main pole magnet, said first poles of said interpole magnets being directed outwardly and attracting a developing material including toner and carrier particles onto the surface of said magnet roller through magnetic induction of said main pole magnet and said interpole magnet; and a doctor blade for restricting the amount of developing material attracted onto the surface of said magnet roller said doctor blade including a magnet member, with a first pole thereof having the same polarity as that of the first pole of said main pole magnet for preventing adhesion of the carrier particles onto the surface of said magnetic roller.

2. A developing apparatus comprising:

a magnetic roller attracting developing material onto its surface through magnetic attraction, said developing material including toner and carrier particles; and a doctor blade for restricting the amount of attraction of the developing material onto the surface of said magnetic roller, said doctor blade being formed, at least on its surface confronting said magnet roller, with a substance triboelectrically charged to the same polarity as that of the carrier particles so as to prevent a buildup of carrier particles on said doctor blade.

3. A developing apparatus according to claim 2, wherein said substance which is triboelectrically charged is made of Teflon.

4. A developing apparatus comprising:

a container for holding a developing material including toner and carrier particles, said container being provided with a container aperture;

a roller assembly including, a magnetic roller rotatably mounted within the container adjacent the aperture, and a plurality of magnets along the inner periphery of said roller, the magnetic axis of one of said plurality of magnets being directed toward the container aperture; and a doctor blade having a magnetic element confronting the container aperture for restricting the amount of developing material attached to said roller assembly, said magnetic element of said doctor blade having a pole orientation independent of the magnetic field created by said roller assembly;

wherein the magnetic pole of said magnetic element of said doctor blade confronting the container aperture is the same as the pole of the magnetic element within said roller having its axis directed toward the container aperture.

5. A developing apparatus comprising:

a container for holding a developing material including toner and carrier particles, said container being provided with a container aperture;

a roller assembly including, a roller rotatably mounted within the container adjacent the aperture, and a plurality of magnets along the inner periphery of said roller, the magnetic axis of one of said plurality of magnets being directed toward the container aperture; and a doctor blade confronting the container aperture for restricting the amount of developing material attracted to said roller assembly, wherein said doctor blade is covered with a material which is triboelectrically charged to the same polarity as that of the carrier particles of said developing material so as to prevent a buildup of carrier particles on said doctor blade.

* * * * *